United States Patent [19]

Goughnour

[11] 4,397,588

[45] Aug. 9, 1983

[54] METHOD OF CONSTRUCTING A COMPACTED GRANULAR OR STONE COLUMN IN SOIL MASSES AND APPARATUS THEREFOR

[75] Inventor: R. Robert Goughnour, Allison Park, Pa.

[73] Assignee: Vibroflotation Foundation Company, Pittsburgh, Pa.

[21] Appl. No.: 227,545

[22] Filed: Jan. 23, 1981

[51] Int. Cl.[3] ..... E02D 7/00

[52] U.S. Cl. ..... 405/236; 405/233; 405/232

[58] Field of Search ..... 405/233, 229, 231, 242, 405/240, 236, 237

[56] References Cited

U.S. PATENT DOCUMENTS

| | | | |
|---|---|---|---|
| 1,157,442 | 10/1915 | Stewart | 405/240 |
| 1,764,948 | 6/1930 | Frankignoul | 405/237 |
| 2,667,749 | 2/1954 | Stuerman . | |
| 2,718,761 | 9/1955 | Steuerman . | |
| 3,130,552 | 4/1964 | Bodine | 405/236 X |
| 3,772,892 | 11/1973 | Ogawa . | |
| 3,858,398 | 1/1975 | Van Weele . | |
| 4,045,966 | 9/1977 | Rusche | 405/240 |
| 4,126,007 | 11/1978 | Mars | 405/271 |

FOREIGN PATENT DOCUMENTS

| | | | |
|---|---|---|---|
| 1123953 | 8/1968 | United Kingdom | 405/233 |

OTHER PUBLICATIONS

"Soil Improvement-History; Capabilities and Outlook," Report by the Committee on Placement and Improvement of Soils of the Geotechnical Engineering Division of the American Society of Civil Engineers, Feb. 1978.

*Primary Examiner*—Dennis L. Taylor
*Attorney, Agent, or Firm*—Carothers & Carothers

[57] ABSTRACT

Compacted granular or stone columns are constructed in soil to increase the load-bearing capacities of the native soil. The upper portion of the compacted granular column is provided with a rigid central core such that vertical loads imposed on the composite column are transferred to a deeper level on the compacted column where the column operates more efficiently. A probe is centrally penetrated downwardly into the compacted granular column, and the resulting cavity is filled with cementitious grout to form a solid core after hardening. The grout may be injected into the cavity so formed in the compacted column at the bottom of the probe as the probe is being withdrawn in predetermined quantities metered in synchronization with the rate of withdrawal of the probe from the core cavity.

14 Claims, 13 Drawing Figures

16
56
40'
40
23
10
11
21
43
52
50
51
54
53
42

METHOD OF CONSTRUCTING A COMPACTED GRANULAR OR STONE COLUMN IN SOIL MASSES AND APPARATUS THEREFOR

The present invention relates generally to improvements relating to the treatment of soil masses for foundations and like structures, and more particularly to the construction of compacted granular or stone columns in soil masses.

The densification of cohesionless granular soils such as sand with vibratory equipment is a well known construction procedure to increase the load-bearing capacities of the soil. One popular method of densifying such cohesionless soil is the use of vibratory earth probes in combination with water jetting and flooding. A good example of this technique is illustrated in Steuerman U.S. Pat. No. 2,718,761. In such a method, the densification of the cohesionless soil is carried out by the application of mechanical vibration and simultaneous application of water nullifying effective stresses which exist between adjacent soil grains. The soil grains in an unconstrained and unstressed condition, are rearranged to their densest possible state under the continued application of vibration, and jetted induced stress reduction. This basic type of process has been economically applied as a foundation solution since the latter part of the 1930s, with considerable success throughout the world.

However, the application of this method in cohesive soils, such as clays or silts, does not produce the same results. In cohesive soils, contact forces between individual particles cannot be eliminated by vibration and, therefore, these soil particles are not separated, even temporarily, during the same process. Similarly, in soil such as fine grain silts with low permeability that exhibit "apparent cohesion," the particles are difficult to separate by such a vibration process. It is for this reason that with regard to discussion of the present invention, these fine grain silts are included in the category of cohesive soils.

Although these afore-mentioned vibration techniques do not materially improve the consistency of cohesive soils, a variant method was developed in Germany approximately twenty years ago to strengthen such soils in situ. This method is generally referred to as a construction technique termed as the construction of stone columns, which strengthens cohesive soils to a point where they are able to sustain considerably larger bearing stresses without developing detrimental or excessive settlement, or bearing capacity failure.

Stone columns, as the name implies, are simply vertical columns of compacted crushed stone, gravel or sand which extend through a deposit of soft material or soil to be strengthened. A number of acceptable methods are available for installing such compacted granular columns or stone columns. An example of such prior art equipment utilized for this purpose is illustrated in the afore-mentioned Steuerman patent and in Steuerman U.S. Pat. No. 2,667,749 and in Van Weele U.S. Pat. No. 3,858,398. Other effective methods are illustrated in Mars U.S. Pat. No. 4,126,007 and in Ogawa U.S. Pat. No. 3,772,892.

When vibratory probes are utilized, similar to the type illustrated in the afore-mentioned Steuerman patents, to construct a sand or stone column, the probe itself generally consists of a 12 to 16 inch diameter hollow cylindrical body which can be, for example, 7 to 15 feet in length and which is connected by a special elastic coupler to an upper series of follower tubes. Eccentric weights in the lower part of the probe are driven by an electric or hydraulic motor operating usually at 3,000 revolutions per minute at 50 Hertz or at 1,800 revolutions per minute at 60 Hertz to create lateral vibrations in the probe or vibrations in the horizontal plane. The total weight of the probe is adjustable by the addition of the afore-mentioned follower tubes which can be heavy or light and which can produce a total weight of approximately 4 to 8 tons for a 45 feet long probe. The electric cables and/or hydraulic hoses and water hoses are connected usually to the uppermost extension tube and two sets of water outlets or jets are located along the probe length. The lower set of water jets are located at the probe's lower tip, and aid in probe penetration, while the upper set of water jets assist in the removal of displaced cohesive material which lies within the probe's path. The complete assembly is usually supported from a commercial crane. Special supporting rigs have also been developed in the past which can exert a downward hydraulic thrust to force the probe into the ground. Other supporting equipment would generally consist of a high capacity-high pressure water pump, a portable energy source to provide power for the probe motor and pumps and a front end loader or other means to feed the required granular backfill material into the soil cavity formed by the probe.

In order to construct a stone column with this type of probe, the probe is penetrated into the soft cohesive soil to a predetermined depth under its own weight and with vibration and assistance of a jetting fluid. The jetting fluid may be water under pressure or compressed air. During the penetration process, the soil immediately surrounding the vibrator is disturbed or remolded to a nominal extent. When water is used during the jetting process, the disturbed material is flushed from the hole, however, true displacement of the in situ soil will occur when compressed air is utilized as the jetting medium. After penetration to the full depth, the probe is withdrawn while the jetting fluid prevents the hole from collapsing. By using water as a jetting medium, a difference in hydrostatic head between the water filled hole and the natural ground water table assists in the stabilization of the cylindrical hole created by the probe. Generally, water should be used when the natural material is fully saturated. Air is preferred in cases where the existing soil is only partially saturated. The use of compressed air prevents the creation of a vacuum beneath the vibrating point when the vibrator is extracted. If desired, the process of penetration may be repeated to insure that the hole remains open over its entire depth and to insure that most of the disturbed material has been flushed out or removed.

At sites where hole stability is not a problem, the probe may then be removed and coarse granular backfill is dumped into the hole. This backfill material generally consists of coarse gravel, crushed stone or slag, sized ¾ to 3 inches. It is possible to use sand, and sand has been used in some applications as explained hereinafter. The probe is then lowered again into the hole and under its own weight with the assistance of vibration, it compacts the backfill material. The probe has a shaped point which enables it to displace the granular backfill radially into the soft in situ soil. This process is generally repeated layer by layer until the compacted column of granular material has been completed.

Repetition of this process and incremental feeding and compacting produces a very dense granular column which is embedded with the native cohesive soil. Depending upon the consistency of the natural soil, columns of 3 to 4 feet in diameter are generally formed.

In the method illustrated in Ogawa U.S. Pat. No. 3,772,892, sand is utilized instead of stone for the column. Nevertheless, these sand columns will be referred to also as stone columns. In this regard, while the term column tends to signify or imply that the columns are rigid elements, they are not completely rigid, and give to a certain extent under vertical loads as will be explained hereinafter. Stone columns should thus be thought of as compacted piles of granular material as opposed to stiff columns.

With the method disclosed in U.S. Pat. No. 3,772,892, the probe in this instance consists of a thick-walled steel tube with a vibrator on the top thereof. The probe is sunk into the subsoil to the required depth, and if necessary, it is done so with the aid of water and/or air jets. A sand plug at the lower end of the probe prevents penetration of soil into the tube. At the required depth, a known volume of sand is placed inside the tube and the tube is withdrawn to some predetermined increment. During withdrawal of the tube, sand is forced out of the tube by air pressure introduced at the top of the sand. The process is repeated and the tube is partially lowered again, forcing the freshly deposited sand into the surrounding soil with the assistance of vibration, thereby creating compaction. The ratio between the steps of extraction and redriving governs the final cross section of the sand column. By repetition of these steps, the sand column is gradually constructed.

Other techniques suitable to form stone columns are also available, such as a ram or weight falling in a cased hole through which gravel or stone is introduced. This type of construction is illustrated in U.S. Pat. No. 4,126,007 of Mars.

Generally, a plurality of such stone columns will be constructed in a square or triangular grid pattern in the originally soft cohesive ground, such that the ground is transformed into a composite mass of vertical compacted granular cylinders with intervening native soil. Such compacted granular columns are used not only for structural foundations, but also for slope stability as a preventive or corrective measure in either cut or fill slopes which may otherwise cause either rotational or translational movement. Such stone columns may also be utilized for embankment settlements. The stone columns may be placed beneath embankments which are underlain with soft cohesive material and thereby can limit and hasten settlements, as well as improve stability. In many cases, the controlling factor in construction is the post-construction settlement caused by consolidation of underlying soft cohesive soil. Stone columns installed in the soft soil not only decrease the total amount of this consolidation settlement, but accelerate the rate of settlement.

The stresses imposed on a vertically loaded compacted granular column or stone column are similar to those imposed on a specimen subjected to a triaxial compression test. Confining pressures imposed by the in situ soil on the stone column act in a manner similar to the cell pressure applied to the triaxial specimen. If the vertical load on either the stone column or the triaxial specimen is increased sufficiently, yield conditions (failure) will occur. However, when this condition is reached in the stone column, bulging occurs at the upper portions of the column, which imposes radial displacement on the in situ soil. In this regard, an illustration is shown in FIG. 8. If the native soil is loaded in such a way that vertical deformation of the column and in situ soil must remain equal, then this vertical deformation occurs simultaneously with the radial deformation imposed by the bulging column. The in situ soil deforms both vertically and radially, with the effect that the radial stresses against the stone column increase. This is illustrated by the horizontal arrows in FIG. 8. Thus, vertical deformation of the stone column does not proceed indefinitely, but reaches some equilibrium value which depends on both the angle of internal friction of the column material and on the compressibility and deformation characteristics of the soft soil.

Since the lateral stresses of the in situ soil increase with depth, stone columns resist vertical loads more efficiently at greater depths. Vertical loads applied to stone columns by a structural foundation or embankment impose the same vertical deflection on the in situ soil as on the columns. The result is that the largest vertical deformation of both the columns and the native soil occurs immediately below the foundation and decreases rapidly with depth, as is illustrated in FIG. 8. It has been shown that virtually all of the settlement compression occurs in the upper 12 feet of the stone column, even though the column itself may be 20 feet to 60 feet deep. Expected total settlement of the columns and the surrounding in situ soil under load, might be expected to be as much as 12 inches.

It should be borne in mind that this bulging effect of the stone column when placed under vertical loads is a desirable effect. As a means of explanation, if a rigid concrete pile in cohesive soil is loaded, it settles developing end bearing and cohesive resisting stresses. A compacted granular column or stone column similarly develops these types of stress, as noted by the end bearing stresses indicated by the vertical arrows at the bottom of the stone column shown in FIG. 8 and by the cohesive resisting stresses indicated by the smaller vertical arrows along the sides of the stone column illustrated in FIG. 8.

However, the stone column as illustrated also bulges and is therefore additionally supported advantageously by lateral stresses exerted by the adjacent in situ soil as illustrated by the horizontal stress arrows in FIG. 8. However, the problem with such conventional stone columns is that settlement is limited to the upper regions of the columns, undesirably causing excessive total settlement. The present inventor discovered that this disadvantage could be greatly alleviated if it were possible to transfer the loads to a deeper level on the stone columns where the columns operate more efficiently as afore-described. This would decrease total settlement of the stone column under load, and would also more uniformly distribute bulging of the column over the entire depth of the column and in the deeper levels of the stone columns where greater efficiency is attained as opposed to having the column bulge only at its upper portions.

The stone column and the method of constructing a stone column in accordance with the teachings of the present invention overcomes the afore-mentioned disadvantages and provides the afore-mentioned desirable objectives of transferring the loads to a deeper level on the stone columns, where the columns operate more efficiently. In its most basic form, the present invention comprises the installation of a rigid central core in at least the upper portion of the compacted granular or stone column. This can be accomplished by driving a core of solid material downwardly and coaxially into the stone column. This can also be accomplished by repenetrating the finished stone column with a vibrating probe or the like to make an elongated cavity in the stone column and then forcing a rigid core into that cavity.

However, the preferred method is to penetrate a probe downwardly into the compacted column of granular material to a predetermined depth to form an elongated cavity in the compacted column and then to withdraw the probe and fill the cavity thus formed in the compacted column with cementitious grout to form a solid core after hardening of the grout.

In addition, by providing the rigid central core in the granular or stone column, the continuity of a water drainage pass through the granular column to the ground surface is unbroken. This is desirable in those situations where drainage through the column is necessary. Conversely, if it is desired to block drainage from the ground surface into the column, the entire composite column with its central core may be grouted over to prevent intrusion of ground water into the compacted granular or stone column. The rigid core also acts to drastically increase the effectiveness of the stone column when used to resist shear failures, as in slope stability.

According to the teachings of the present invention, a compacted granular or stone column is first constructed in the soil by any of the afore-mentioned conventional techniques. This is accomplished by penetrating a probe downwardly into the soil to be compacted to a predetermined depth thereby forming an elongated cavity in the soil. The probe is withdrawn from the soil cavity and at least a portion of the cavity is backfilled with granular material such as crushed stone, gravel or sand, and this granular material is compacted in the cavity to form a compacted column of granular material.

The stone column thus having been formed in the conventional manner is then reconstructed in accordance with the teachings of the present invention by penetrating a probe downwardly into the compacted column to a predetermined depth, thereby forming an elongated cavity in the compacted column itself. The probe is withdrawn from the cavity formed in the compacted column, and the cavity thus formed in the compacted column is filled with cementitious grout to form a solid core after hardening of the grout.

While it may be possible to merely pour the grout into the cavity thus formed in the compacted column after withdrawal of the probe, the preferred method is to inject grout into the cavity at the lower end of the probe while the probe is simultaneously being withdrawn from the cavity formed within the compacted granular column. The grout is injected into the cavity at the lower end of the probe in predetermined quantities metered in synchronization with the rate of withdrawal of the probe from the cavity. One way of accomplishing this is with the use of a positive displacement grout pump, the pump output of which is regulated with the rate of withdrawal of the probe from the cavity.

The injection of grout into the cavity beneath the probe being withdrawn will generally be regulated such that the cavity being formed beneath the probe as it is being withdrawn is continually filled with grout. In fact, it will be found desirable in some circumstances to continually fill the cavity beneath the retracting probe with the grout in the cavity being subjected to continuous pressure by injecting quantities of grout into the cavity at a rate slightly faster than the rate of withdrawal of the probe, such that the grout within the cavity is always under pressure, so that the grout will be forced into the interstices of the walls of the cavity.

The probe utilized for initially forming the cavity in the soil and also for forming the core cavity in the stone column itself is preferably of the type which can be laterally vibrated. This greatly assists in forming the cavities and also in compacting the granular backfill. After the initial cavity is formed in the soil, the vibrating probe is usually withdrawn and a predetermined amount of backfill is inserted into the soil cavity. The probe is then reinserted into the cavity, and into this quantity of backfill, to compact the granular material under the load of the probe and with the lateral vibration of the probe. This step is then successively repeated so that the compacted stone column is built layer by layer.

After the stone column is completed, the laterally vibrating probe is then reinserted into the compacted column to form the core cavity for injection of grout. When withdrawing the probe while simultaneously injecting grout into the bottom of the cavity, it may be found desirable under some situations to continue lateral vibrations of the probe in order to work the grout into the interstices of the core cavity.

When penetrating either the native soil to form the initial soil cavity or when penetrating the stone column to form the core cavity, it is also desirable to jet a fluid under pressure, such as compressed air or water, from the bottom of the probe to assist in penetration.

If it is desirable not to have water surface drainage seep into the stone column, then the stone column is only built up to a predetermined level in the cavity formed in the soil and then after the grout core in the upper portions of the stone column have been formed, the remaining top portion of the soil cavity is completely filled also with cementitious grout such that it covers the entire top of the compacted column after the grout core has been formed therein.

The preferred probe to be utilized in constructing the stone columns of the present invention comprises an elongated vibrator probe housing with means to vertically raise and lower the housing such as a crane. Vibrator means are provided in the housing for vibrating the probe housing laterally. Generally, such vibrators will consist of eccentric weights which are rotated. A conduit is secured to the probe housing and extends for at least substantially the entire length of the housing, and opens at its bottom end adjacent the bottom of the probe housing. Means is then provided for providing a cementitious grout such as a grout hopper, and a pump is connected to the upper end of the afore-mentioned conduit and to the grout supply to pump grout in metered quantities downwardly through the conduit and out the bottom opening at the bottom of the probe.

When it is desired to synchronize the pump output with the rate of withdrawal of the probe from the core cavity formed within the stone column, this can be accomplished by a detector which detects the rate that the probe is withdrawn or raised, and accordingly regulating the output of the grout pump. For example, the means to raise and lower the housing may include a wire rope and sheave combination and a detector may be positioned in relation to the sheave to detect the degree of rotation of the sheave when the housing is being raised to determine the rate that the housing is being raised for metering the grout ejection or output of the grout pump.

When the grout conduit is not being used to pump grout, it is desirable to continually pump water through the conduit when the probe is being utilized to penetrate the soil or the stone column in order to prevent the outlet of the grout conduit from being plugged.

Additional water jets are also desirably positioned at the bottom of the probe housing for assisting downward penetration of the probe into the soil.

The probe housing may be effectively elongated by the addition of extension or follower tubes which interconnect and are interposed between the top of the probe housing and the means to vertically raise and lower the probe housing. This not only effectively lengthens the probe as required, but also provides a means for regulating the amount of weight of the resultant probe for soil penetration.

Other objects and advantages appear in the following description and claims.

The accompanying drawings show, for the purpose of exemplification without limiting the invention or the claims thereto, certain practical embodiments illustrating the principles of this invention wherein:

Figure 1:
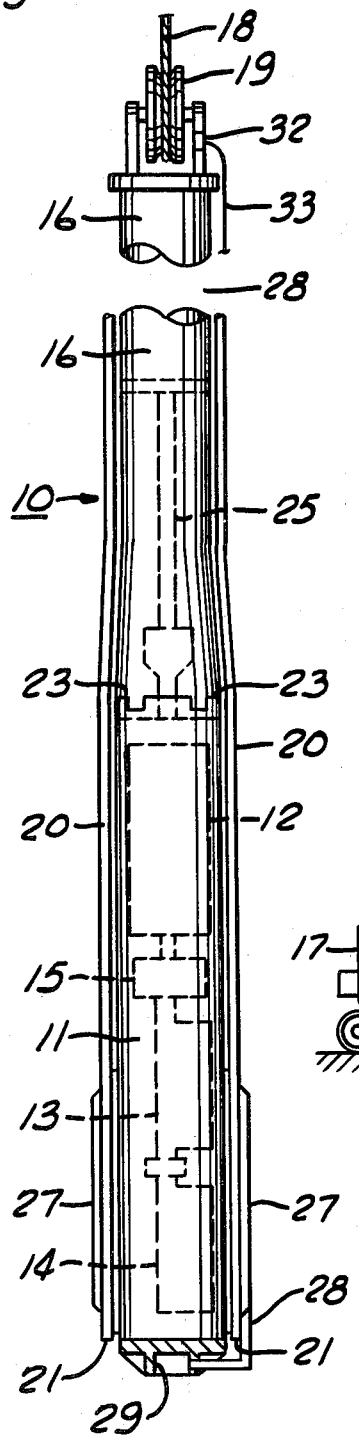
FIG. 1 is a diagrammatic view in front elevation illustrating the probe of the present invention.

The method of the present invention is described in conjunction with the earth probe illustrated in the drawings. While this particular probe has novelty in and of itself, and is part of the subject matter of the present invention, nevertheless, with regard to the method of the present invention for constructing compacted granular or stone columns in soil, it should be borne in mind that other types of probes may be employed as hereinbefore described.

Referring first to the vibrator probe as illustrated in FIG. 1, the vibrator probe is basically similar to the type of vibrating probe illustrated in Steuerman U.S. Pat. No. 2,667,749 with some novel improvements. The vibrator probe 10 is comprised of an elongated probe housing 11 containing means for vibrating the probe housing laterally. This means in turn comprises electric or hydraulic motor 12 which rotatingly drives eccentric weights 13 and 14 through coupling 15. Eccentric weights 13 and 14 are coupled together as indicated to drive in unison and are mounted in bearings within housing 11. A series of follower or extension tubes 16 are connected to the top of probe housing 11 to effectively elongate and add weight to probe 10 for soil penetration. In fact, the weight of extension tubes 16 may be varied to gain the desired penetration effect. Any number of extension tubes may be added to the probe, depending upon the particular application or the depth of the stone column to be constructed.

Figure 3:
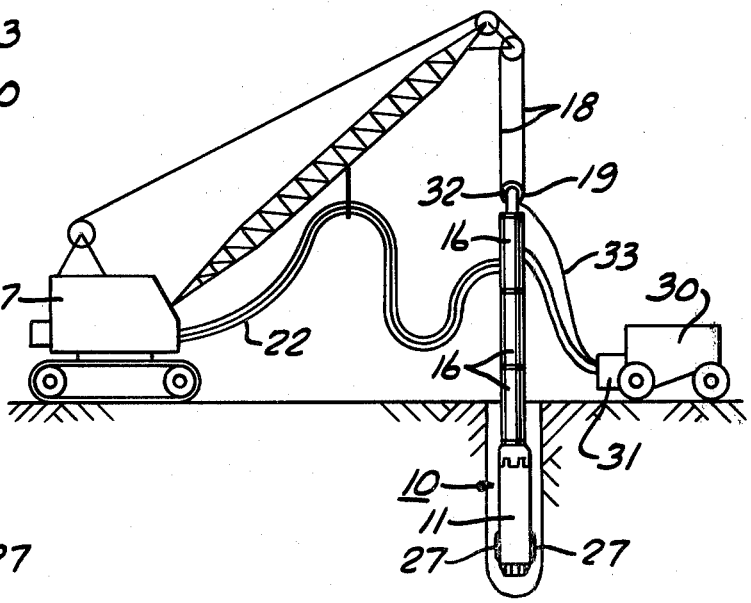
FIG. 3 is a diagrammatic view in side elevation illustrating the probe of FIG. 1 as being carried by a crane and being further connected to a grout supply in order to carry out the method of the present invention for constructing compacted granular or stone columns.

The vibrator probe 10 is vertically raised and lowered by any conventional means such as the crane 17 illustrated in FIG. 3. In this regard, a conventional wire rope 18 and sheave 19 are employed.

Referring to FIG. 1, water feed lines 20 extend down the side of extension tube 16 and probe housing 11 and exit at the bottom of the probe at lower water jets 21. Referring also to FIG. 3, water under pressure or air under pressure is applied to these conduits 20 in a conventional manner via the flexible feed pipe 22. The water or air under pressure which jets from the bottom of the probe at 21 is thus utilized to assist in penetrating the probe downwardly into the earth. Water or air jets are also provided at positions 23 on probe 10 as illustrated in FIG. 1 for reasons which will be discussed in greater detail hereinafter. Valving is provided such that water jets 21 and 23 may either be operated independently or simultaneously.

Eccentric weights 13 and 14 on the lower part of the probe are driven by the electric or hydraulic motor 12 which usually operates in the range of 3,000 revolutions per minute at 50 Hertz to 1,800 revolutions per minute at 60 Hertz to create vibrations in a horizontal plane.

The probe housing 11 is connected by a special elastic coupling 25 to follower tubes 16 in order to dampen vibrations which would otherwise be imparted to follower tubes 16. The total weight of the probe is adjustable by the addition of heavy or light weight follower tubes 16 which can produce a total weight of approximately 4 to 8 tons for a 45 feet long probe. All electric cables or hydraulic hoses and water or air hoses are connected to the uppermost extension tube as illustrated in FIG. 3, and the electrics or hydraulics are supplied through hydraulic conduit or electric cable 26 from a conventional hydraulic or electric power source.

While compressed air may be utilized, for description purposes the use of water as the jetting fluid will be described. The lower set of water jets 21 on the probe tip aid in probe penetration while the upper set of water jets 23 assist in the removal of displaced cohesive material which lies within the probe path.

While the probe 10 is illustrated as being supported by a commercial crane 17, special supporting rigs may be substituted or added (not shown) which can exert a downward hydraulic thrust to assist in forcing the probe 10 into the ground. Other additional supporting equipment might normally consist of a high capacity-high pressure water pump, a portable energy source to provide power to the motor 12, and a front end loader to feed required backfill material into the cavity to be formed in the soil as hereinafter described.

Fins 27 are circumferentially positioned about the bottom of probe 10 in order to prevent rotation of the probe on downward penetration into the soil.

Probe 10 differs from the conventional vibrator probe by the addition of a grout feed pipe or conduit 28, which extends for almost the full length of the probe as is the case with the water conduit 20. Grout conduit 28 terminates or exits into the nose cone cavity 29 at the tip of probe 10. In order to provide cementitious grout for feeding into grout conduit 28, a grout hopper 30 (FIG. 3) is provided. Grout hopper 30 is further provided with positive displacement grout pump 31 which feed forces grout from hopper 30 into conduit 28 to pump grout in metered quantities downwardly through conduit 28 and out of nose cone cavity 29 when pump 31 is energized.

A metering means is provided for controlling the operation of pump 31 in synchronization with the rate that housing 11 is raised by the crane in order to eject grout through the nose cone tip 29 of the probe in predetermined metered quantities relative to the rate that housing 11 is being raised. This metering means includes the use of magnetic detector 32 which is electrically connected to the energization or power supply system for pump 31 via conductor 33. Referring with particular reference to FIG. 2, sheave 19 is provided on its side face 35 with a plurality of circumferentially spaced permanent magnets 36. When crane 17 is raising probe 10 and detector 32 is switched to its on mode, detector 32 will detect the degree of rotation of sheave 19 as housing 11 is being raised by counting the passages of permanent magnets 36 on rotating sheave 19. Detector 32 accordingly sends out electric pulses which in turn correspondingly energize positive displacement pump 31 in order to meter grout ejection at nose cone 29 of the probe 10 in predetermined metered quantities relative to the rate the housing 11 is being raised.

The method of constructing a compacted granular or stone columne in soil to increase load-bearing capacities thereof, together with the resulting compacted granular or stone column of the present invention are discussed hereinafter in relation to the remaining Figures. Construction of the compacted granular or stone column is described with the utilization of the vibratory probe disclosed in FIGS. 1 through 3, even though other types of probes may be utilized to carry out the construction method for constructing the compacted stone column of the present invention.

In order to construct a compacted granular or stone column in soil according to the teachings of the present method, a conventional compacted granular or stone column is first constructed in any conventional manner as previously described. For the purpose of illustration, construction of a stone column will be described using the probe 10 illustrated in FIGS. 1 through 3.

Figure 4:
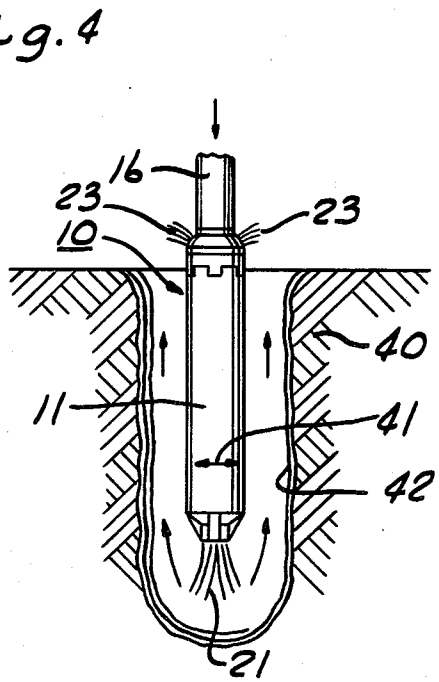
FIG. 4 is a diagrammatic view in side elevation illustrating the probe of FIG. 1 in the initial step of penetrating soil to eventually construct a stone column.

Referring to FIG. 4, the probe 10 is penetrated into the soft cohesive soil 40 to a predetermined depth under its own weight and with lateral vibrations as indicated by arrow 41 and with the assistance of the jetting fluid 21 which may be water or compressed air, but in this instance, it is water under pressure. During the penetration process, the soil immediately surrounding the vibrator or probe is disturbed or remolded to a nominal extent. The disturbed material is flushed from the hole by water from jet 21 and also from the action of jet 23. After the probe has penetrated downwardly to a predetermined depth to form the elongated cavity 42 in the soil 40, a certain amount of the soil 40 will be somewhat more compacted than in its natural state around the cavity 42 as indicated at 40' in FIG. 5.

Figure 6:
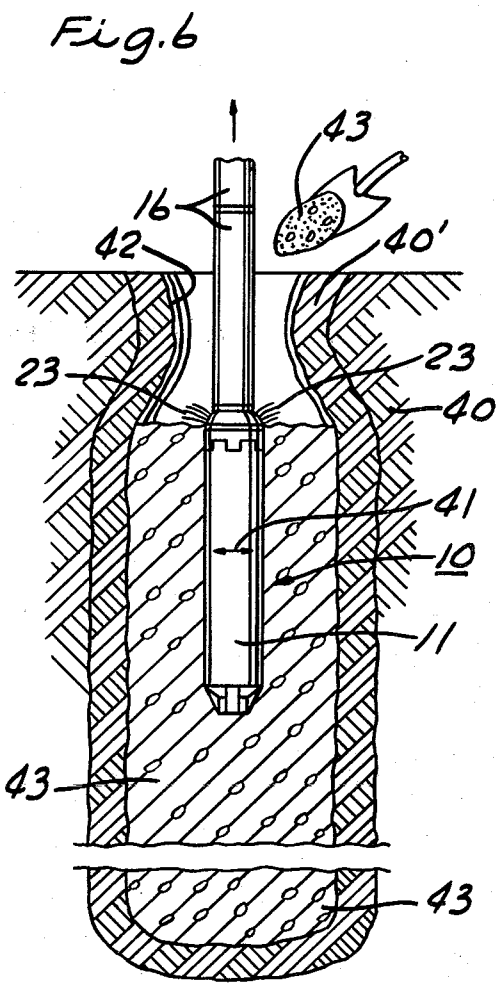
FIG. 6 is a diagrammatic view in side elevation illustrating a continuation of the method step illustrated in FIG. 5 toward construction of a stone column.
Figure 5:
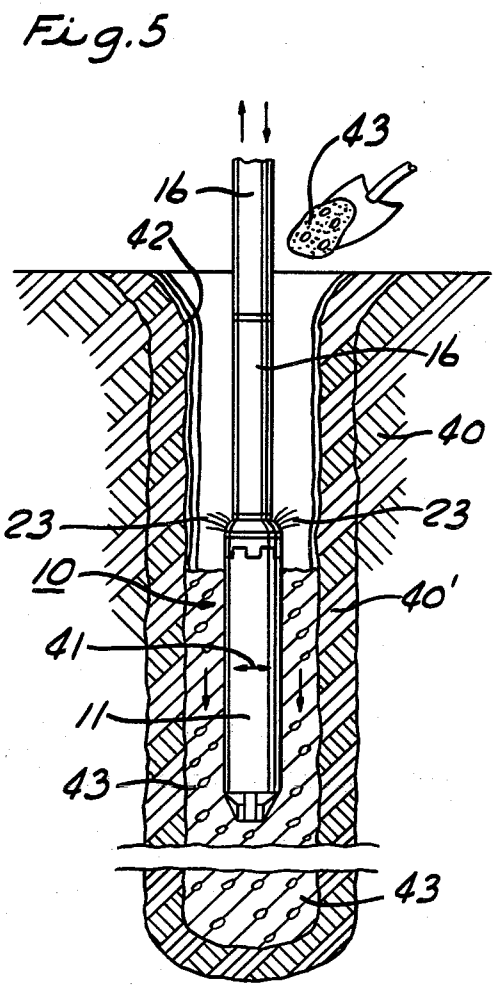
FIG. 5 is a diagrammatic view in side elevation illustrating the second step in constructing a stone column by utilizing the probe shown in FIG. 1.

After the elongated soil cavity 42 is formed, the probe 10 is withdrawn and a layer of backfill in the form of granular material 43 is dumped into the soil cavity 42. This granular backfill is disclosed here as coarse granular material such as crushed stone, gravel or slag, sized from ¾ to 3 inches in diameter. As illustrated in FIG. 5, the probe 10 is then lowered into the cavity 42 under its own weight and with assistance of vibrations as shown at 41, the backfill 43 is repenetrated and compacted. The process is continually repeated as illustrated in FIG. 6, and the probe displaces the granular backfill radially into the soft in situ soil 40 thereby building layer by layer and expanding the stone column 43 as illustrated in FIG. 6. The process is repeated until a completed conventional type compacted granular or stone column is attained as illustrated in FIG. 7.

Figures 7, 8, 9:
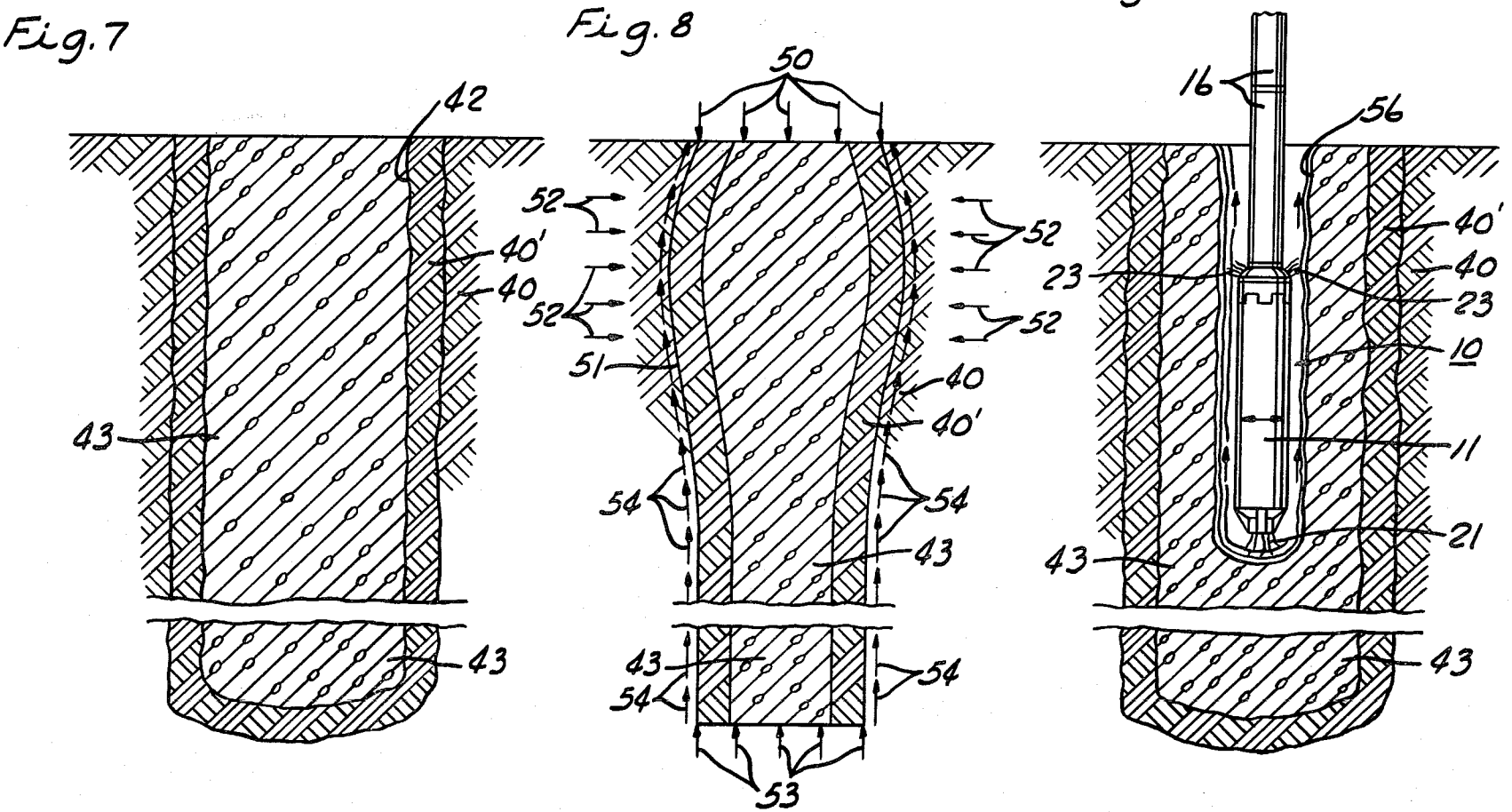
FIG. 7 is a diagrammatic view in vertical cross section illustrating a stone column constructed in accordance with the sequence of method steps illustrated in FIGS. 4, 5 and 6.
FIG. 8 is a diagrammatic view in vertical section of the stone column illustrated in FIG. 7 after a vertical load has been applied thereto.
FIG. 9 is a diagrammatic view in partial vertical section illustrating the stone column of FIG. 7 as being repenetrated by the probe illustrated in FIG. 1 to form a core cavity in the upper portion of the stone column.

FIG. 8 illustrates the stone column 43 of FIG. 7 after the stone column has been vertically loaded as indicated by load vectors 50. Under such vertical loads, the stone column 43 will yield, and bulging occurs at the upper portion of the column as indicated at 51. The in situ soil 40 deforms both vertically and radially with the effect that the radial stresses indicated by vectors 52 against the stone column 43 increase. Thus, when the stone column 43 in a cohesive soil 40 is loaded, it settles, developing end bearing stresses indicated by vectors 53 and cohesive resisting stresses indicated by vectors 54, and the stone column also bulges at the upper portions 51 so that it is supported by lateral stresses 52 exerted by the adjacent in situ soil.

However, as previously pointed out, since the lateral stresses of the in situ soil increase with depth, the stone column 43 resists vertical loads more efficiently at greater depths. However, the conventional stone column 43 illustrated in FIG. 8 under vertical load has its largest vertical deformation of both the column and the native soil immediately below the foundation level, and this deformation decreases very rapidly with depth. It is thus an object of the present invention to produce a system which will transfer loads to a deeper level on the stone column 43 where the column operates more efficiently.

Thus, in order to construct a compacted granular stone column in accordance with the teachings of the present invention, the compacted granular or stone column illustrated in FIG. 7 is further modified by repenetrating the probe 10 with water flow as before, and in addition, water is also continually flowed through grout feed conduit or pipe 28 during this and all penetrating of the soil or stone column in order to prevent clogging of the grout pipe and nose cone cavity 29.

In this manner, the probe is thus repenetrated into the completed stone column 43 to a predetermined depth. As just one example, the entire depth of the column might be 40 to 60 feet, and the probe 10 might be repenetrated to a depth of, say, 12 feet. This depth will vary with construction conditions. In this manner, an elongated cavity 56 is formed in the compacted column 43. When the probe 10 repenetrates the stone column 43, it self-centers within the stone column.

Figure 10:
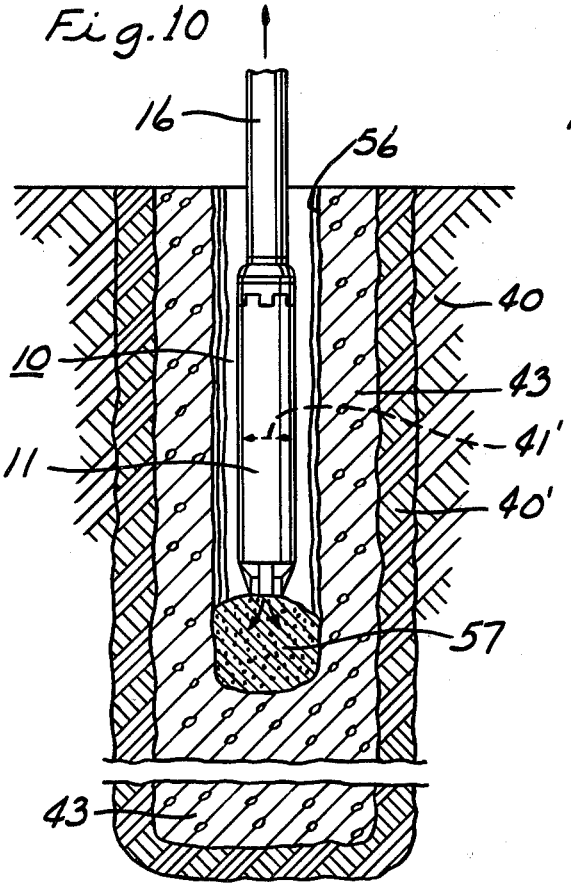
FIG. 10 is a diagrammatic view in partial vertical section illustrating grout being injected into the central cavity formed in the stone column as the probe is being withdrawn.

After forming the core cavity 56 within the stone column 43, the probe 10 is withdrawn and grout is fed simultaneously at a measured and synchronized rate as previously described, and as illustrated at 57 in FIG. 10, in order to fill the core cavity with cementitious grout 57. As indicated by dashed arrow 41', the vibrator may or may not be operating at this time, as desired. Also, as previously described, the grout 57 may be injected at a rate slightly greater than the rate of withdrawal of probe 10 in order to inject it into the bottom of the core cavity 56 under pressure, so that the grout 57 will work its way into the interstices of the stone of column 43. This is also assisted by the vibrations of the probe 10.

Figure 11:
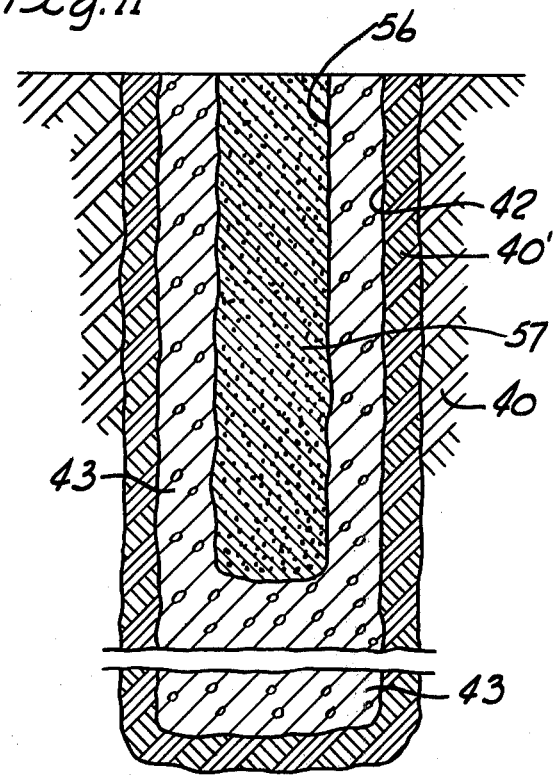
FIG. 11 is a diagrammatic view in vertical section illustrating the stone column of the present invention with the grout core as constructed in accordance with the method teachings of the present invention.

The completed composite and compacted granular or stone column of the present invention is illustrated in FIG. 11 having the upper grout core 57 which is hardened or cured into a rigid central core.

As an alternative construction procedure, a separate probe could be utilized to perform only the grout operation, instead of using the same probe for penetration and compaction in addition to grout feed.

Figure 2:
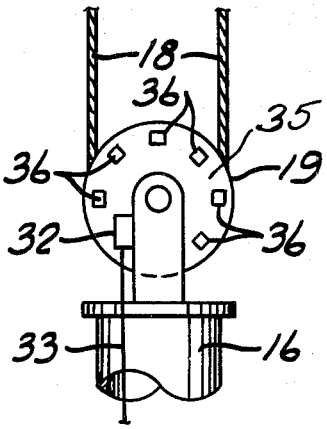
FIG. 2 is an enlarged view in side elevation of the upper portion of the probe illustrated in FIG. 1 showing the wire rope and sheave in combination with a detector for detecting the rate of rotation of the sheave.

As previously described, the positive displacement grout pump 31 will inject grout into the cavity 56 at the lower end of probe 10 in predetermined quantities metered in synchronization with the rate of withdrawal of probe 10 from cavity 56 by means of the detector 32 which activates grout pump 31 as previously described in conjunction with FIGS. 2 and 3. As an alternative, a laborer could manually operate a positive displacement pump which pumps a measured amount of grout with each stroke, whereby he would apply one stroke for each calibration marked on the side of the probe 10 on the follower tubes 16 as the tube is withdrawn. The amount of grout ejected during each stroke would be adjustable to provide the desired grout core diameter.

Figure 12:
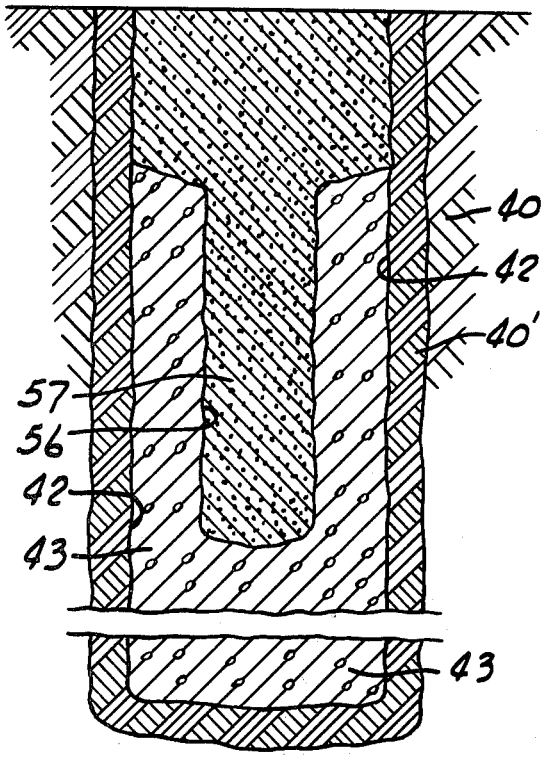
FIG. 12 is a diagrammatic view in vertical section illustrating the composite stone column of FIG. 11 with a modification wherein the entire upper portion of the composite column is grouted over to prevent seepage of surface water into the column.

By grouting only the central core of column 43, continuity of the drainage path downwardly through stone column 43 to the ground surface is maintained. However, if it is desired to block drainage from the ground surface into the stone column 43, the grout can be applied over the entire composite column cross section as illustrated in FIG. 12. To accomplish this, the stone column 43 in the first instance is not constructed all the way to the ground surface as illustrated in FIG. 12.

Figure 13:
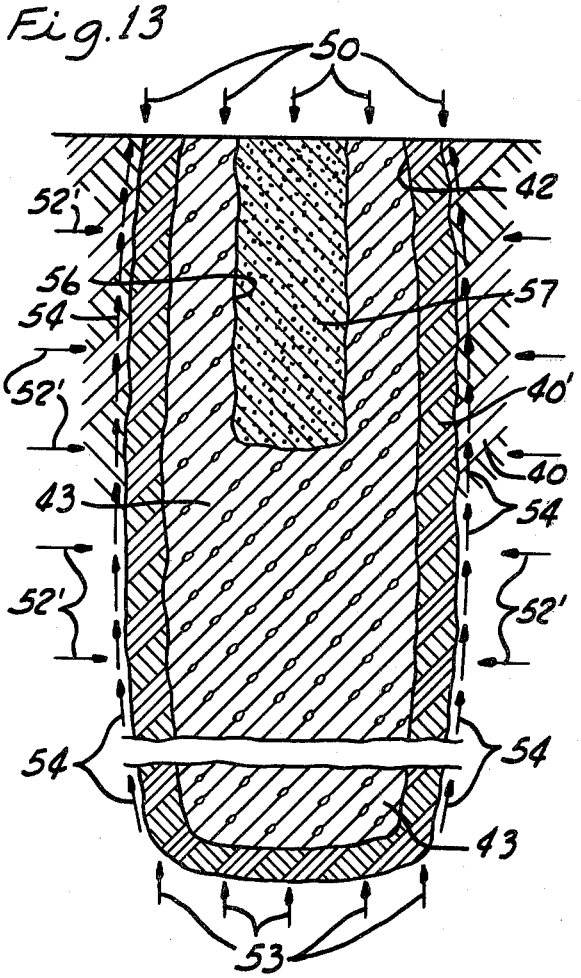
FIG. 13 is a diagrammatic view in vertical section illustrating the composite stone column of the present invention as shown in FIG. 11 after having a vertical load applied thereto.

When the composite column of the present invention, such as illustrated in FIG. 11, is vertically loaded, the results are illustrated in FIG. 13. By comparing this Figure to FIG. 8, it can be seen that the result is that the loads are transferred to a deeper level in the column 43 where the column operates more efficiently due to the effect of rigid core 57. This causes the column to settle less and further, more uniformly distributes the lateral stresses 52' over the entire, or a greater portion, of the column 43 and at lower depths in the column as opposed to the very pronounced bulge only at the upper portion of the column illustrated in FIG. 8. Thus, the lateral stresses 52' act lower on the column providing a composite stone column which can resist vertical loads much more efficiently. In addition, the grouted core column of the present invention drastically increases the effectiveness of the stone column to resist shear failures, which is a very important factor for such stone columns when they are used in sloped stability applications.

I claim:

1. A method of constructing a compacted granular or stone column in soil to increase load-bearing capacities comprising the steps of penetrating a probe downwardly into soil to be compacted to a predetermined depth thereby forming an elongated cavity in the soil, withdrawing the probe from the soil cavity, backfilling at least a portion of the cavity with granular material and compacting the granular material in the cavity to form a compacted column, penetrating a probe downwardly into the compacted column to a predetermined depth thereby forming an elongated cavity in the compacted column, withdrawing the probe from the cavity formed in the compacted column, and filling the cavity formed in the compacted column with a cementitious grout to form a solid core after hardening of the grout.

2. The method of claim 1, wherein the steps of withdrawing the probe from the cavity formed in the compacted column and filling the cavity formed in the compacted column with grout are carried out by simultaneously withdrawing the probe whie injecting grout into the cavity at the lower end of the probe in predetermined quantities metered in synchronization with the rate of withdrawal of the probe from the cavity.

3. The method of claim 2, wherein the step of injecting grout is carried out by pumping the grout into the cavity formed in the compacted column with a positive displacement grout pump and regulating the pump output with the rate of withdrawal of the probe.

4. The method of claim 3, wherein the pump output is regulated to continually fill the cavity formed in the compacted column by the probe with grout as the probe is being withdrawn.

5. The method of claim 3, wherein the pump output is regulated to continually fill the cavity formed in the compacted column by the probe with grout under pressure in the column cavity as the probe is being withdrawn.

6. The method of claim 1, wherein the step of backfilling is carried out by backfilling at least a portion of the cavity with fine granular material such as sand as the granular material.

7. The method of claim 1, wherein the step of backfilling is carried out by backfilling at least a portion of the cavity with coarse granular material such as crushed stone or gravel as the granular material.

8. The method of claim 1, wherein at least one of the steps of penetrating the probe downwardly also includes the step of laterally vibrating the probe while penetrating it.

9. The method of claim 1, wherein at least one of the steps of withdrawing the probe also includes the step of laterally vibrating the probe while withdrawing it.

10. The method of claim 9, wherein the probe is laterally vibrated during the step of withdrawing it from the cavity formed in the compacted column and the step of filling the column cavity with grout is carried out simultaneously with the step of withdrawing the probe from the compacted cavity.

11. The method of claim 1, wherein the steps of backfilling with granular material and compacting the granular material to form a compacted column are carried out by backfilling the soil cavity with layers of granular material and successively repenetrating each added layer with a laterally vibrating probe for compaction to form the compacted column layer by layer.

12. The method of claim 1 or 2, including the step of jetting a fluid under pressure from the bottom of the probe during at least one of the steps of penetrating to assist in penetration of the probe.

13. The method of claim 1 or 2, wherein the step of backfilling of the soil cavity is carried out to completely fill the soil cavity with granular material.

14. The method of claim 1 or 2, wherein the step of backfilling of the soil cavity is carried out to only partially fill the soil cavity to a predetermined level, and including the step of filling the remaining top portion of the soil cavity with cementitious grout on top of the compacted column after the grout core has been formed therein.

* * * * *